US007987757B2

(12) United States Patent
Willett

(10) Patent No.: US 7,987,757 B2
(45) Date of Patent: Aug. 2, 2011

(54) BREAD SLICER

(75) Inventor: Paul Eaton Willett, Whiteside (AU)

(73) Assignee: Moffat PTY Limited, Mulgrave, Victoria (AU)

( * ) Notice: Subject to any disclaimer, the term of this patent is extended or adjusted under 35 U.S.C. 154(b) by 392 days.

(21) Appl. No.: 12/233,733

(22) Filed: Sep. 19, 2008

(65) Prior Publication Data

US 2009/0078099 A1 Mar. 26, 2009

(30) Foreign Application Priority Data

Sep. 20, 2007 (AU) ..... 2007905147

(51) Int. Cl.
*B26D 7/06* (2006.01)

(52) U.S. Cl. ..... 83/419; 83/437.2; 83/932

(58) Field of Classification Search ..... 83/419, 83/932, 703, 410, 409, 415, 437.2
See application file for complete search history.

(56) References Cited

U.S. PATENT DOCUMENTS

| | | | | |
|---|---|---|---|---|
| 1,986,189 | A * | 1/1935 | Egan | 83/91 |
| 2,379,911 | A * | 7/1945 | Kottmann | 83/435.2 |
| 2,437,124 | A * | 3/1948 | Petskeyes | 83/425.2 |
| 5,095,791 | A * | 3/1992 | Jongerius | 83/155 |
| 5,461,956 | A | 10/1995 | Petersen et al. | 83/221 |
| 2001/0037711 | A1 | 11/2001 | Van Cauwenberghe | |
| 2005/0009653 | A1 | 1/2005 | Weinstein et al. | |
| 2006/0075859 | A1 | 4/2006 | Willett | |

FOREIGN PATENT DOCUMENTS

| | | | |
|---|---|---|---|
| DE | 20 2004 013623 | U1 | 11/2004 |
| DE | 202004021207 | U1 | 3/2007 |
| EP | 0615821 | A1 | 9/1994 |
| EP | 0955134 | A2 | 11/1999 |
| EP | 1386702 | A1 | 10/2005 |
| FR | 2786422 | A1 | 6/2000 |
| GB | 538919 | | 8/1941 |
| JP | 2007021695 | A | 2/2007 |
| WO | 01/23151 | A1 | 4/2001 |

OTHER PUBLICATIONS

European Search Report from corresponding European Application No. 08 16 4653.

Australian Search Report from Corresponding Australian Application No. 2007905147.

* cited by examiner

*Primary Examiner* — Stephen Choi

(74) *Attorney, Agent, or Firm* — David D. Brush; Westman, Champlin & Kelly, P.A.

(57) ABSTRACT

A bread slicer is provided, which includes a receiving area for receiving a loaf of bread; a return area for delivering sliced bread; and a path along which the bread moves from the receiving area to the return area. The path includes a substantially downwardly inclined surface extending from the rear of the receiving area to the return area. The slicer has a slicing element for slicing the bread as it passes from the receiving area to the return area; and a guard for preventing access to the slicing element from the receiving area. The guard is fixed relative to a guide mechanism, the guide mechanism being movable along a path divergent from the inclined path to advance the loaf along the path.

5 Claims, 3 Drawing Sheets

BREAD SLICER

FIELD OF THE INVENTION

The invention relates to bread slicing and in particular a bread slicer which is safer to operate.

BACKGROUND OF THE INVENTION

Bread slicing machines are commonplace in most bakeries and retail outlets. In many commercial operations, the loaves of bread are sliced prior to wrapping by an apparatus having either a series of FIG. 8 bands of blades or through reciprocating blades which allow multiple slices to be cut at once or by sickle slicing one slice at a time using a single blade. In current slicer machines, the operator places one or more loaves on a platform and the loaves are moved from one side of the machine through the blades to the other side of the machine by mechanical devices or by gravity. Depending on the feed mechanism, the platform can be inclined or flat.

In bakeries and retail outlets, there is often a shortage of available space and so the space allocated to a slicing machine is limited. Therefore a bread slicer which occupies space efficiently without compromising safety is desirable.

In some versions of reciprocating bread slicers, the reciprocating blades are exposed or easily accessed by the operators exposing the operators of the bread slicers to the risk of injury by contact with moving or stationary blades.

In other versions of reciprocating bread slicers where the reciprocating frame is housed within an enclosure, there is still a risk that the operator's hands can come into contact with the stationary reciprocating blades during loading of the loaves of bread onto the supporting table.

The area of greatest working danger is the sharp side of the reciprocating blades of a bread slicer, and although many forms of guard exist, most only guard against the operator contacting moving blades. The blades being high in number and very sharp, are still a high risk even when stopped.

Objects of the present invention include to provide a safer, more space efficient slicer or at least provide an alternative in the market place.

SUMMARY OF THE INVENTION

In one aspect of the invention there is provided a bread slicer comprising a receiving area for receiving a loaf of bread from an operator side of the slicer, a return area for returning sliced bread to operator side, a path along which the bread moves from the receiving area to the return area, slicing means intermediate the path for slicing the bread, the path comprising a substantially downwardly inclined surface extending from the rear of the receiving area to the return area on the operator's side of the slicer; and a guard for preventing access to the slicing means, the guard being mounted relative to a guard mechanism, the guard mechanism being movable to a position withdrawn from the inclined surface as the loaf advances along the path.

The guard is movable between a bread receiving position in which the guard closes the path and prevents access to the blades from the receiving area and a loaf releasing position in which the guard releases the loaf to allow progress towards the slicing means. The surface along which the bread moves may be curved. The path of movement of the guide mechanism preferably retracts the guard from the inclined surface as the guard moves from the bread receiving position to the loaf releasing position. The movement of the guard mechanism is preferably along a path, preferably a linear path divergent from the inclined surface.

The guard preferably withdraws to a position below the inclined surface.

The receiving area is preferably an open top deck, and has a first portion which is preferably is substantially horizontal. The downwardly inclined surface is preferably curved so as to have a steeper inclination at its upper end.

Advantageously the slicing means may be slicing blades traversing the path of the loaf. Access to the blades may be restricted by a guard.

In another aspect of the invention, there is provided a bread slicer comprising:

a receiving area for receiving a loaf of bread;

a return area for delivering sliced bread;

a path along which the bread moves from the receiving area to the return area, comprising a substantially downwardly inclined surface extending from the rear of the receiving area to the return area;

slicing means for slicing the bread as it passes from the receiving area to the return area; and a guard for preventing access to the slicing means from the receiving area, wherein the guard is movable between a bread receiving position in which the guard closes the path and prevents access to the blades from the receiving area and a loaf releasing position in which the guard releases the loaf to progress towards the slicing means, the guard being mounted to a guard mechanism, the guard mechanism being movable to withdraw the guard from the inclined surface to advance the loaf along the path.

The guard preferably withdraws to a position below the inclined surface.

The movement of the guard mechanism is preferably along a path, preferably a linear path divergent from the inclined surface.

In this second aspect, the loaf may be fed to the receiving area from the operator's side of the slicer and the path comprising the substantially downwardly inclined surface extends from the rear of the receiving area to the return area which is also on the operator's side of the slicer.

The receiving area is preferably an open top deck, and has a first portion which is preferably is substantially horizontal. The downwardly inclined surface is preferably curved so as to have a steeper inclination at its upper end.

In a preferred form of the first and second aspects of invention, the path along which the bread moves is curved.

In operation, the loaf rests upon the guard as it progresses from the receiving area along the path between the receiving area and the return area. The guard mechanism for the guard moves along a path divergent from the inclined path to advance the loaf along the path. The path of movement of the guard is preferably from substantially linear.

As the guard is mounted to the guard mechanism, the divergence of the guard mechanism path from the downwardly inclined surface gradually retracts the width of the guard from the inclined surface until the loaf, no longer retrained by the guard, progresses along the inclined surface to the slicing means.

The slicer of the first and second aspect may further be provided with a loaf pusher for pushing the loaf along the path. The pushing force for the pusher may be provided by the weight of the pusher or it may be provide by a pusher mechanism. The pusher may be pivotally mounted and may include a handle. Most preferably the weight of the pusher is distributed in an overcentre arrangement to minimise operator effort.

The loaf pusher trails the guard along the path to advance the loaf towards the slicing means. The loaf pusher moves between a first position in which the loaf is able to be received on the loaf receiving position and a second position in which the loaf is advanced into the slicing means.

In operation, the loaf pusher is generally spaced from a first member of the guard by at least the width of a loaf of bread. The loaf pusher comprises a contact region and an arm to pivotally mounted to the frame of the bread slicer. The path along which the loaf moves is arcuate shaped and the radius of the arc preferably corresponds with the length of the arm of the loaf pusher.

The guard comprising the first member upon which, in use, the loaf will be placed, further comprises a second member spaced from the first member by an intermediate region. The intermediate region is preferably at least the width of a loaf of bread allowing the pusher sufficient space to engage and trail the loaf of bread down the inclined space.

The second member cooperates with the pusher as it returns to its initial position to also return the guard mechanism is its default position and/or to the bread receiving position.

DETAILED DESCRIPTION OF THE EMBODIMENTS

Figure 1:
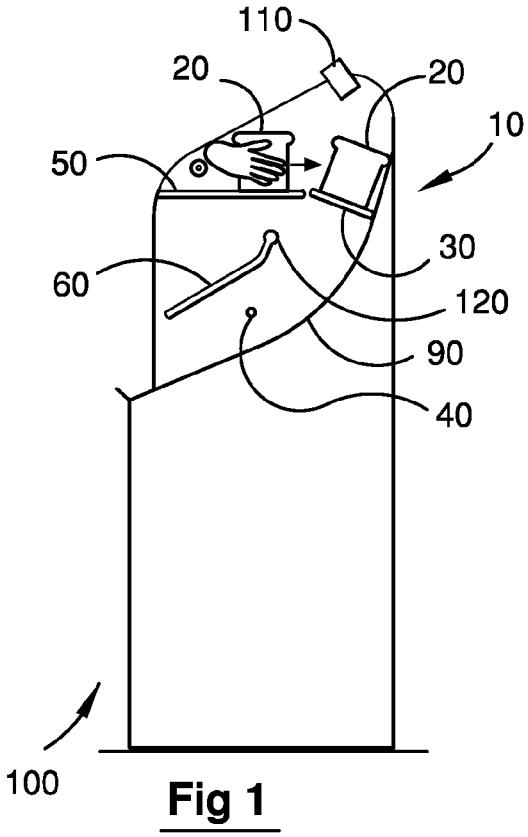
FIGS. 1 to 4 are sequential simplified schematic cross sectional views of the bread slicer according to an embodiment of the invention.

FIGS. 1-9 show a bread slicer in accordance with a preferred embodiment of the invention. The bread slicer 10 comprises a loading or receiving area 50 onto which a loaf of bread is fed to the bread slicer. Contained within a housing at the rear of the receiving area 50 is a path comprising a downwardly inclined surface or lower guide 90 leading to the return or exit 25, preferably on the operator side of the slicer. The loading area may be an open top deck or it may be contained within a housing having an opening to receive a loaf of bread onto loading area 50.

Within the housing between the loading area and the return area is a slicer means, or element, for slicing a loaf as it progresses along the path defined by lower guide 90. In one example, the slicing means preferably includes reciprocating blades 70.

In order to restrict access to the slicing means from the loading area, the slicer of the invention further comprises a back guard mechanism preferably contained within the housing. The guard mechanism comprises a guard 30 for initially preventing access to the path between the receiving area 50 and the exit 25. In this embodiment, the guard mechanism includes a first member (guard 30) and a second member 130 spaced apart by an intermediate region. The guard mechanism is preferably mounted on a sliding mount such as a linear bearing 140. The sliding mount is mounted in proximity to the lower guide 90 of the downwardly inclined path. The first and second members 30, 130 are in the form of combs made up of spaced fingers extending through corresponding apertures in the downwardly inclined lower guide 90 (not shown). In the raised position, the guard 30 closes the path between the loading area and the slicer blades. The intermediate region between the guard 30 and second member 130 is sufficient to permit a loaf from the loading area to be loaded onto upper surface of the guard without contacting the lateral extension of the second member 130.

The guard mechanism is then released and biased under their own weight or by a mechanical or spring bias to move downwardly to a position where the loaf progresses through the slicer blades. The linear bearing 140 defines a linear path diverging from the curved path defined by lower guide 90 so that (as illustrated in FIGS. 5 through 9) as the guard 30 slides downwardly on the linear bearing guide mechanism 140, guard 30 retreats behind lower guide 90 to provide a clear lower region 40 for the loaf 20 to reach the slicing blades 70. Where second member 130 is sufficiently large, it may be moved into a position to block path 40 when the first member is withdrawn below inclined surface and thereby effectively guard the slicing blade 70, preventing operator injuries from inserting hands into the loaf path 40. Hence in an embodiment, the second member 130 may act as a second guard.

Once the loaf has been sliced and removed from return area 25, the guard mechanism returns to its default position with guard 30 raised as shown in FIG. 1.

An embodiment of the invention preferably further comprises a pusher mechanism 150 comprising a pushing element 110 and handle 160 pivotally connected to the housing or main body 180 of the slicer at pivot point 170. The handle 160 is a cantilever arrangement around pivot 170 providing a mechanical advantage so that the pusher mechanism 150 is balanced to be neutrally weighted in the position illustrated in FIG. 7. Minimal operator effort is thus required to rotate the pusher to the position illustrated in FIG. 8 and thereafter the weight of the pusher mechanism bears on the loaf 20 to push the loaf through the blades 70 without further operator intervention. The pusher element trails the loaf as it progresses down path 90 and guard 30 withdraws from path 90, thereby preventing access to the blades once the guard 30 has withdrawn. The pusher element 110 is arranged to engage with the second member 130 as it returns to its default position so that in a single motion the operator can move handle 160 to raise both the pusher element and the guide 30 to the default position shown in FIG. 1.

Figure 10:
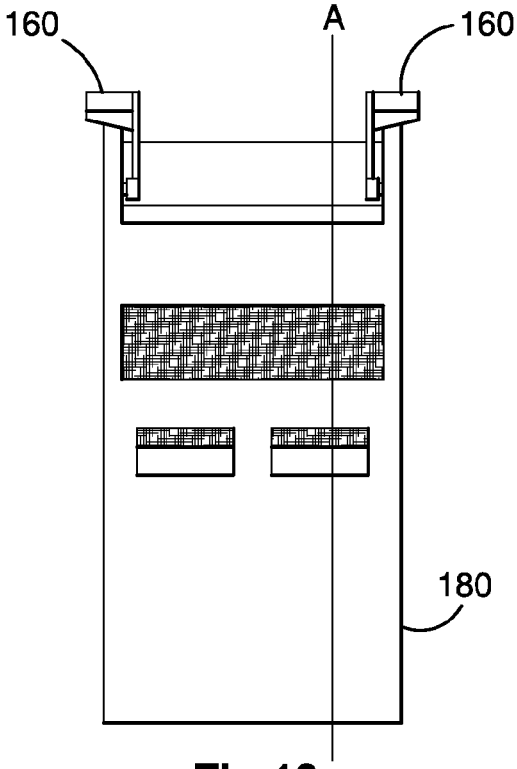
FIG. 10 is a simplified front view of the slicer of FIGS. 5 to 9.

As illustrated in FIG. 10 the pusher mechanism 150 is built in two halves on each side of the machine such that handle 160 does not extend across the machine and thereby does not obstruct the placing of bread on the preloading deck 50.

FIG. 1 shows the bread slicer 10 at an initial stage of the bread slicing cycle. An operator (not shown) places a loaf of bread 20 on the loading deck and pushes it towards the back of the machine where it is received on first guard 30.

Figure 2:
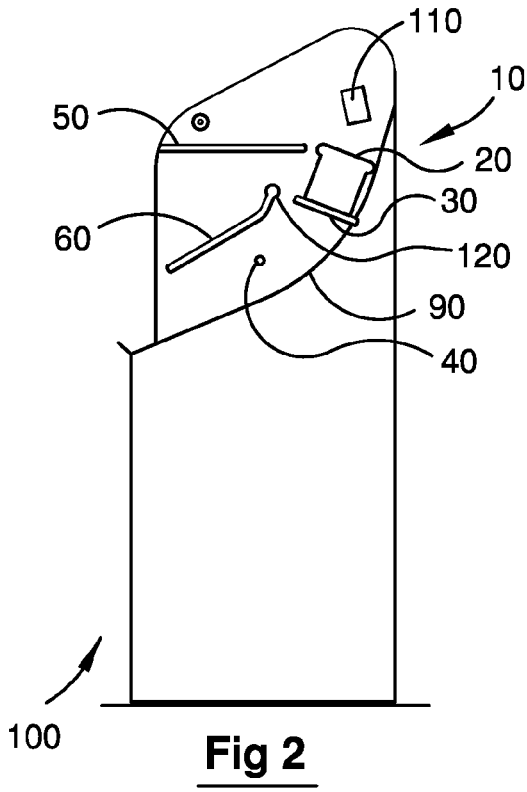
Figure 3:
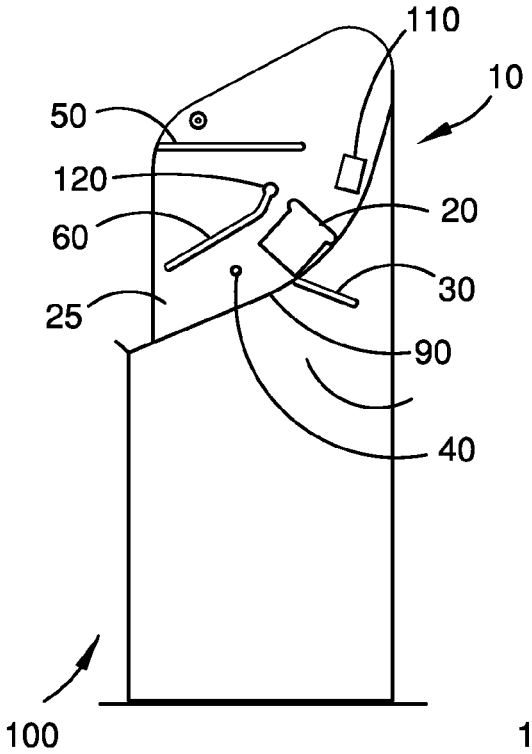
Figure 4:
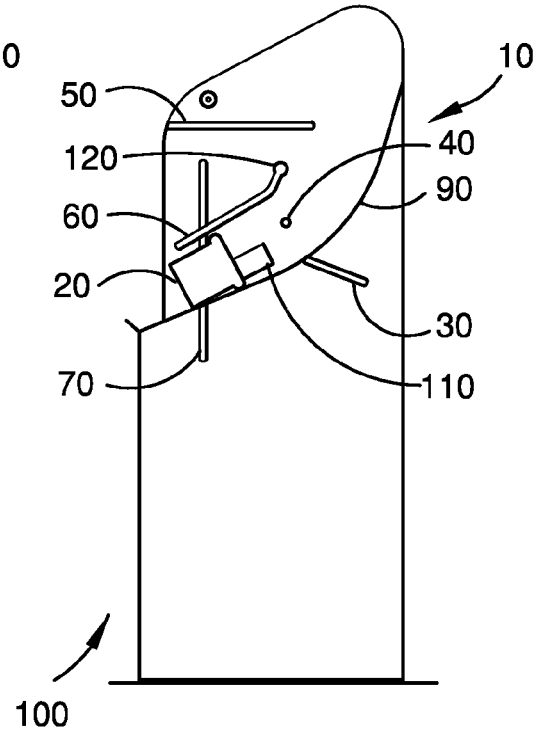
Figure 5:
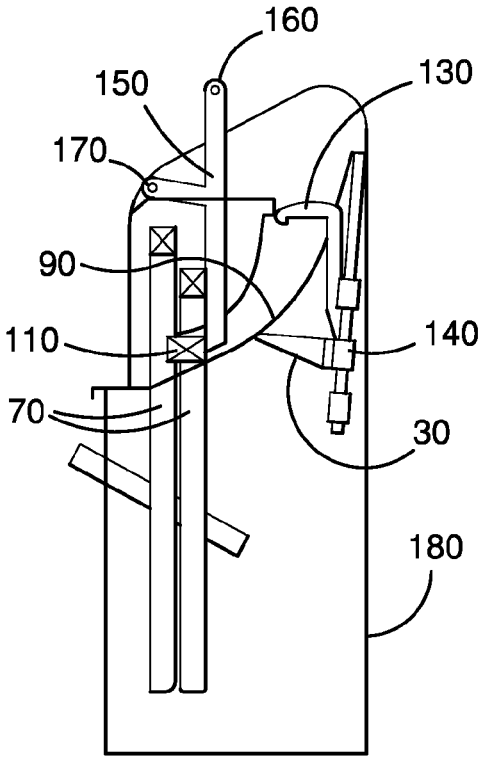
FIGS. 5 to 9 are sequential simplified schematic cross sectional views of the bread slicer according to an embodiment of the invention.
Figure 6:
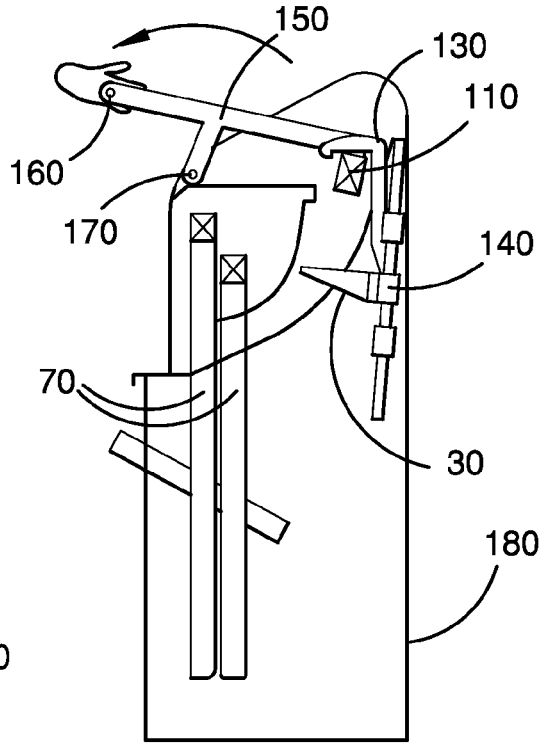
Figure 7:
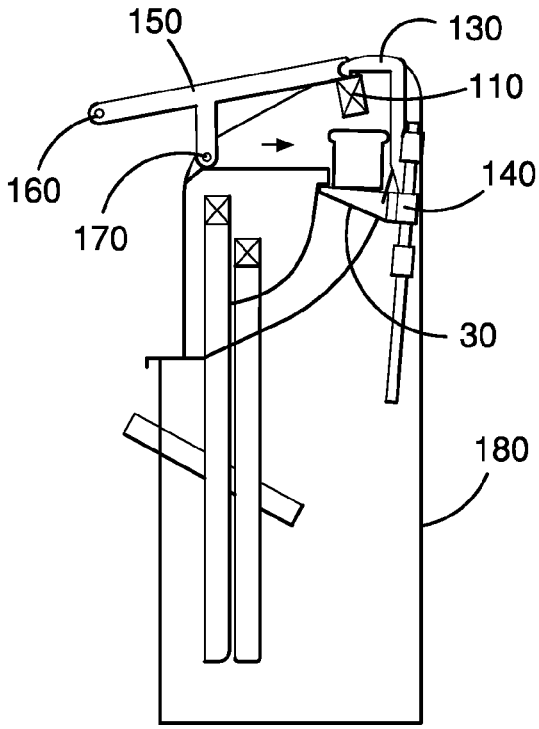
Figure 8:
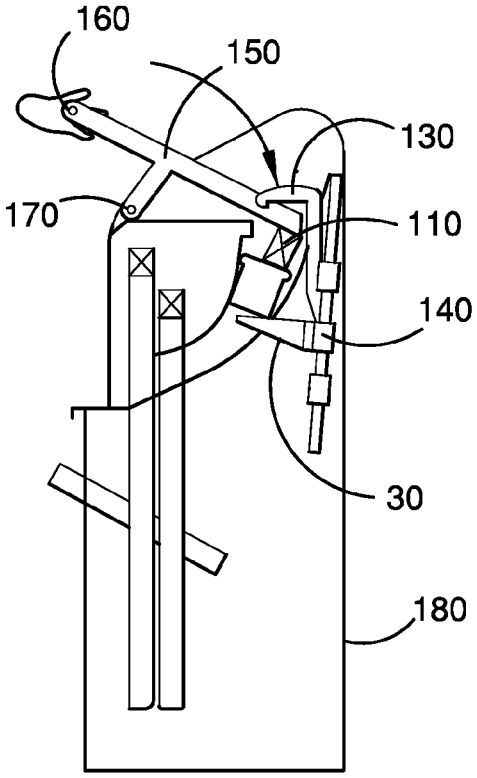
Figure 9:
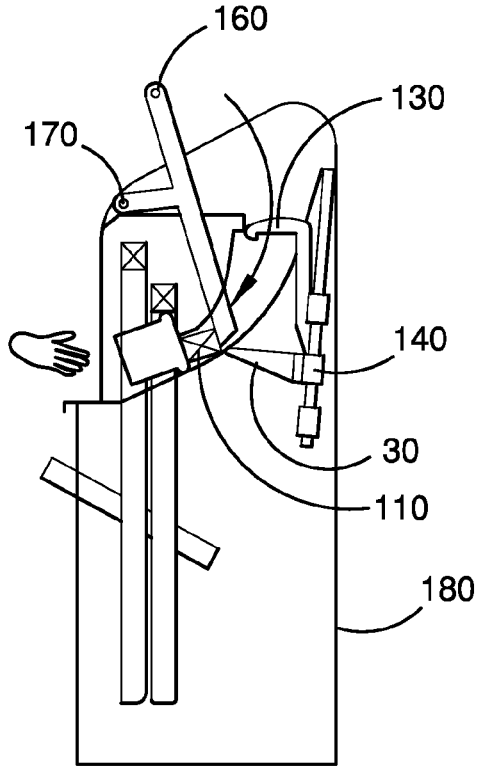

As shown in FIG. 2 the guard 30 is lowered such that bread 20 moves into lower region 40 defined by the path 90 and the upper guide 60. As illustrated in FIGS. 2 through 4, the loaf of bread 20 then moves down lower region 40 and is passed through blades 70. A sliced loaf of bread is then returned to the operator at the operator side of the machine 100. Pusher 110 follows the loaf 20 through the lower region 40 to push the bread 20 through the slicing blades 70.

The path 90 curves from a steep inclination at the back of the machine to a lesser inclination at the front of the machine (i.e. the operator side 100). The inclination towards the front of the machine 100 advantageously presents a corner of the bread 20 to the slicing blades to thereby allow blades 70 to penetrate a hard crust on the loaf at a small point. This greatly improves cutting efficiency.

The upper guide 60 is a comb made up of spaced fingers interposed between the slicing blades 70. The guide 60 is pivotally mounted at pivot 120 and has sufficient weight to press on the bread 20 and hold it in place thereby reducing vibration of the bread 20 as it passes through the slicing blades 70.

In another embodiment, the guard mechanism may be pivotally mounted below the inclined surface so the guard pivots out of the path to a position level with or below the inclined surface allowing the loaf to pass the guard. If a pusher is employed the pusher may interact with the guard returning it to its loading position as the pusher returns to the default position.

The bread slicer of the preferred embodiment of the invention effectively prevents access to the sharp side of the blades by containing the blades within a housing and shielded by the loading deck. The only access to sharp side of the blade is through path 90 which is guarded by the guard 30. Another advantage of this arrangement is that the machine can be operated from a single side. This allows the machine to be installed against a wall or even in a service counter. The machine therefore occupies less space, this is a particular advantage as often bakeries are operated in locations where retail space is relatively expensive.

Although not shown in the figures the bread slicer may be fitted with a bagging spade as in Australian application no. 2006201074, the contents of which are herein incorporated by reference.

It will also be understood that the term "comprises" (or its grammatical variants) as used in this specification is equivalent to the term "includes" and should not be taken as excluding the presence of other elements or features.

The invention claimed is:

1. A bread slicer comprising a substantially downwardly inclined surface defining a downward bread path for conveying bread from a bread receiving area to a return area;

slicing blades to slice the bread as it moves along the bread path;

a guard mechanism including a guard movable along a guard path, the guard having a first member spaced from a second member in a fixed relationship, the guard path being divergent from the bread path and extending from:

a bread receiving position, in which the first member of the guard supports the bread on the bread path and closes the bread path preventing access to the slicing blades, downwardly to a bread release position, where the first member is completely retracted from the bread path allowing bread supported by first member to progress to the slicing blades; and a loaf pusher to push bread from the receiving area of the bread path to the slicing blades, the loaf pusher cooperating with the first member of the guard to progress bread along the bread path and the second member of the guard to return the guard mechanism to the bread receiving position.

2. The bread slicer of claim 1 wherein the loaf pusher comprises a contact region and a pivotally mounted arm.

3. The bread slicer of claim 2 wherein the path along which the bread moves is arcuate shaped and the radius of the arc corresponds with the length of the arm of the loaf pusher.

4. The bread slicer of claim 3 wherein the guard path is substantially linear.

5. The bread slicer of claim 1 wherein the first member of the guard includes a plurality of spaced fingers, the substantially downwardly inclined surface of the bread path including openings complementary to the spaced fingers, the spaced fingers being able to project through the complementary openings to close the bread path to prevent access to the slicing mechanism from the receiving area, and being withdrawable from the bread path through the complementary openings in the bread path to release the bread to the slicing mechanism.

* * * * *